United States Patent [19]

Privat

[11] 4,394,914

[45] Jul. 26, 1983

[54] TELESCOPIC CRANES

[75] Inventor: Albert Privat, St. Chamond, France

[73] Assignee: Creusot-Loire, Paris, France

[21] Appl. No.: 218,175

[22] Filed: Dec. 19, 1980

Related U.S. Application Data

[63] Continuation of Ser. No. 956,597, Oct. 30, 1978, abandoned.

[30] Foreign Application Priority Data

Nov. 21, 1977 [FR] France ..... 77 34850

[51] Int. Cl.[3] ..... B66C 23/00

[52] U.S. Cl. ..... 212/203; 212/222; 212/184; 414/144; 52/118

[58] Field of Search ..... 212/222, 203, 184, 296, 212/261, 188, 268; 414/144, 718; 52/118, 116, 114

[56] References Cited

U.S. PATENT DOCUMENTS

| | | | |
|---|---|---|---|
| 3,198,345 | 8/1965 | Brekelbaum et al. | 212/222 |
| 3,462,023 | 8/1969 | Grove | 212/268 |
| 3,664,516 | 5/1972 | Goudy | 212/222 |
| 3,872,977 | 3/1975 | Noly | 212/184 |
| 3,968,884 | 7/1976 | Johnson et al. | 212/184 |
| 4,036,372 | 7/1977 | Ros et al. | 212/184 |
| 4,039,085 | 8/1977 | Livengood | 212/184 |
| 4,169,535 | 10/1979 | Bryan, Jr. | 212/167 |

FOREIGN PATENT DOCUMENTS

| | | | |
|---|---|---|---|
| 771848 | 11/1967 | Canada | 212/184 |
| 1374253 | 11/1974 | United Kingdom | 212/184 |

*Primary Examiner*—John J. Love
*Assistant Examiner*—L. E. Williams
*Attorney, Agent, or Firm*—Pollock, Vande Sande & Priddy

[57] ABSTRACT

In a telescopic crane comprising a telescopic shaft and a variable length boom pivotally mounted on the end of the shaft, the position of the boom relative to the shaft is controlled by a jack pivotally connected at one end to the shaft and at the other end to one end of a mast, the other end of the mast being connected to the boom, and ties connect the one end of the mast to the boom outwardly of the connection of the boom to the other end of the mask.

3 Claims, 8 Drawing Figures

TELESCOPIC CRANES

This is a continuation of application Ser. No. 956,597 filed Oct. 30, 1978, now abandoned.

The present invention relates to improvements in telescopic cranes having folding booms of variable length.

Booms of variable length are currently widely used in combination with telescopic cranes which can be erected rapidly. In order to vary the direction of the boom relative to that of the main shaft, two kinds of devices are usually employed:

(1) a first kind which, in order to vary the direction of the boom by itself, uses a cable-and-winch system placed at the level of the machine and independent of the main winching device of the crane, and (2) a second kind which makes it possible to vary the boom by using a mast-and-ties system, the said mast being articulated at the level of the end of the shaft, and the lower ties being attached to one of the telescopic elements of the main shaft; the inclination of the boom is automatically varied by retracting or extending this telescopic element to a greater or lesser degree.

However, these two prior art devices have serious disadvantages. A first disadvantage is their relatively long erection time, which is of the order of about one several hours, whereas the main shaft is erected in a few minutes. In order to be really operational, this type of system having a boom of variable length must also be capable of being erected very rapidly, so that the unit retains its primary property that it can be used virtually instantaneously. A second disadvantage of the prior art devices is that they do not make it possible to work easily at very different heights. In fact, in the case of the first device, it would be necessary to act simultaneously on the telescoping of the main shaft and on the boom winch, this being a particularly difficult operation. As regards the second device, it can only be applied, by difinition, at a well-defined shaft height, since the telescoping of the elements has the effect of varying the direction of the boom. Finally, a third, particularly serious disadvantage in the use of these known devices is the accident risk which results therefrom. In fact, in both cases, there is always the possibility of a false maneuver which would result in varying the direction of the boom beyond the limits for which the unit was calculated. This can cause catastrophic accidents if the unit has not been made oversize.

The present invention provide a telescopic crane comprising a shaft comprising a plurality of telescopic elements, a boom of variable length, and means for varying the length of said boom comprising a separate jack which is rotatable about an axle firmly connected with its base and with the end of one of said telescopic elements of said shaft, the rod of said jack being connected to the end of a mast which is rotatable about another axle firmly connected with its base and with said boom, said end of said mast being joined by tie means to at least one point on said boom which is located outwardly of the axle of rotation of said mast.

The invention will be more clearly understood from the following description of an embodiment thereof, given by way of example only, with reference to the accompanying drawings. In the drawings.

Figure 4:
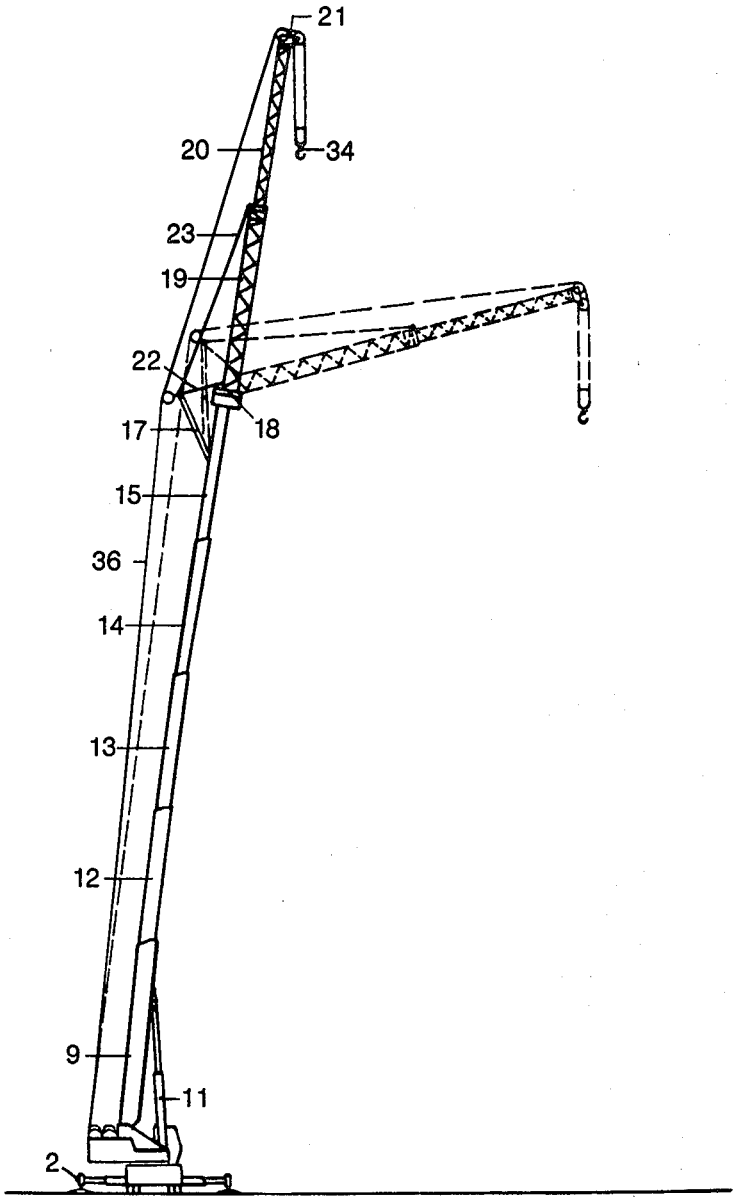
Figure 5:
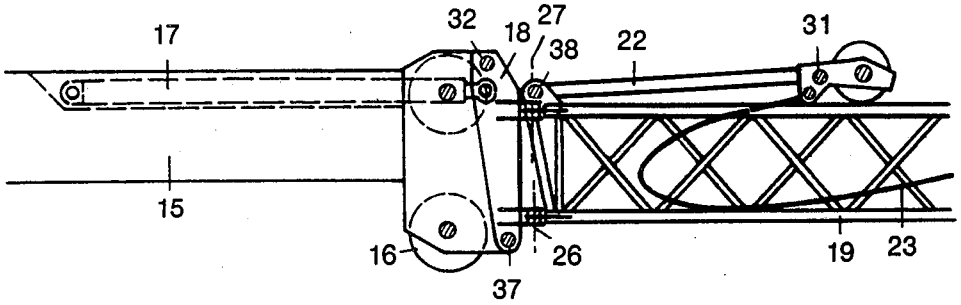
Figure 6:
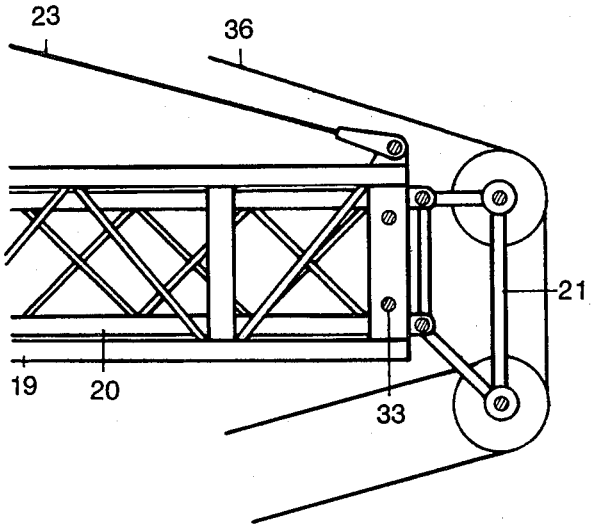
Figure 7:
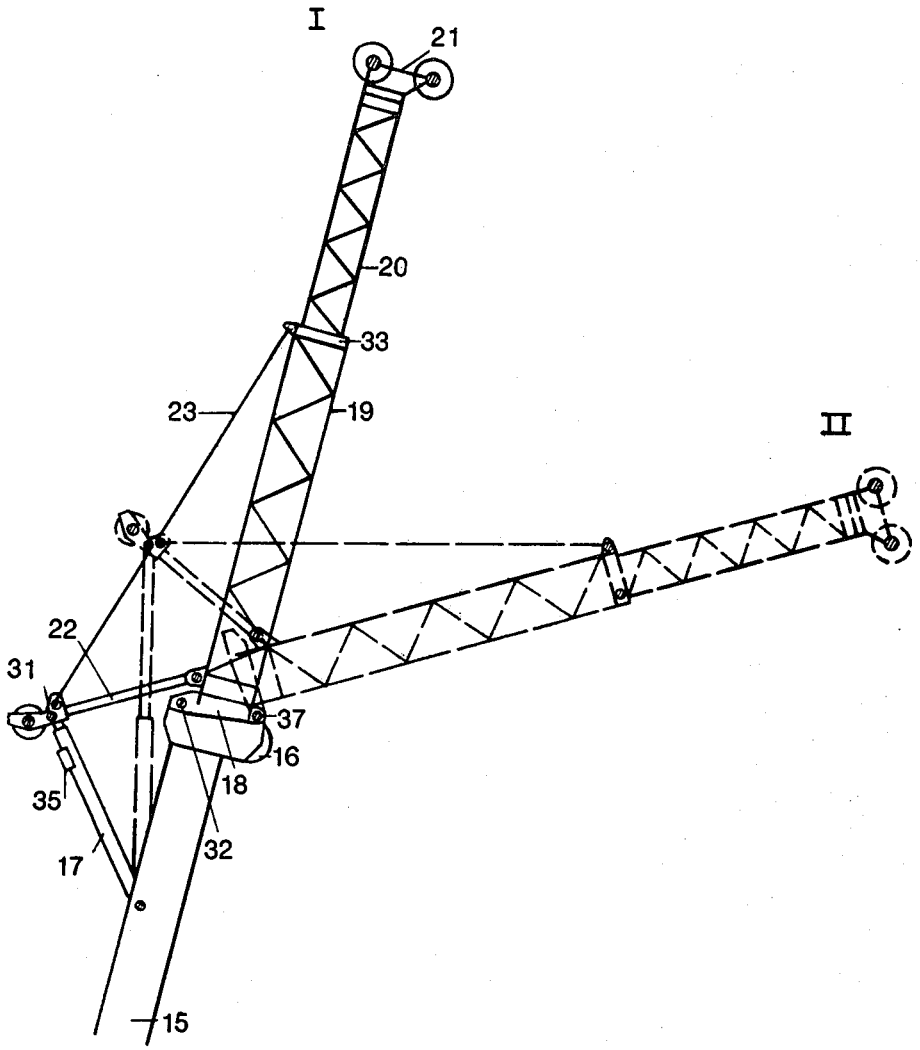
Figure 8:
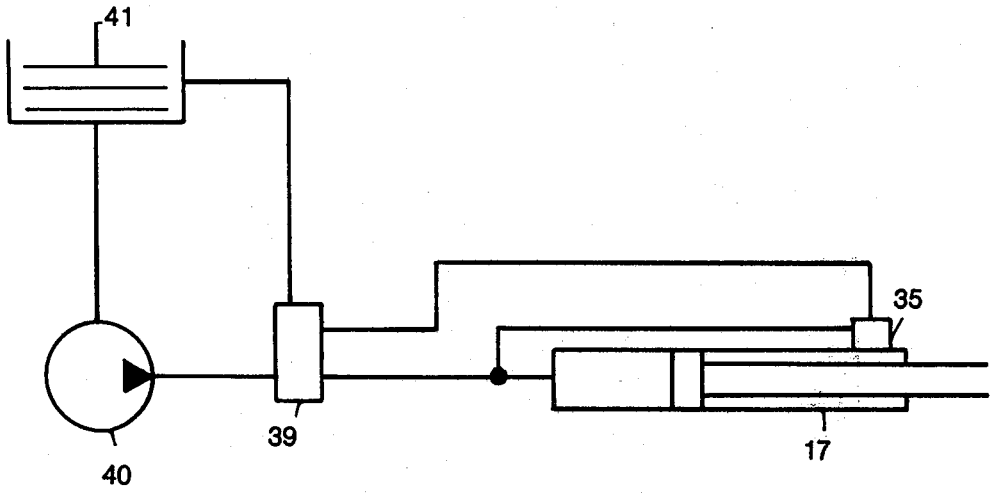

FIG. 4 schematically represents the shaft entirely open and raised and also the boom in extreme working positions;

FIG. 5 shows the end of the shaft head and the elements which are attached thereto;

FIG. 6 is a view of the front end of the boom;

FIG. 7 shows in detail the components which make it possible to change the inclination of the boom in the vertical plane; and FIG. 8 shows an hydraulic diagram for controlling the jack which assures the variation in length of the boom.

Figure 1:
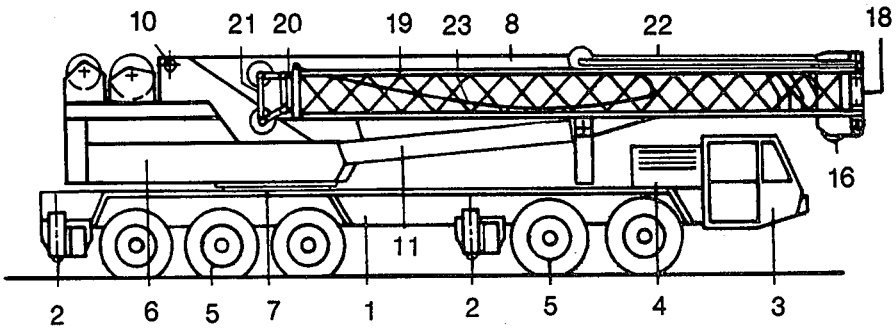
FIG. 1 shows, in side elevation, an embodiment of a mobile crane according to the invention, comprising a telescopic shaft and a boom arranged along the shaft, in the transporting position.
Figure 2:
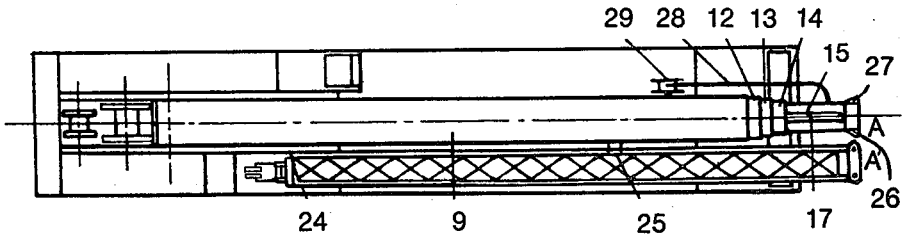
FIG.2 is a plan view of the unit of FIG. 1.

In FIGS. 1 and 2, the reference 1 denotes an infrastructure, such as a lorry, chassis or trailer, which carries the crane. The infrastructure 1 is conventionally fitted with steadying feet 2, a driver's cabin 3, transmission means 4 and wheels 5 permitting movement. A superstructure 6, joined to the chassis by means of an attachment 7, permits horizontal rotation and is fitted with the elements necessary for the operation of the crane.

The crane comprises a shaft 8 which consists of:

a base element 9 which is articulated on the superstructure 6 at a pivot point 10 and joined to a jack 11 for raising the shaft;

successive telescopic elements 12, 13 and 14 which slide respectively into one another, independently or simultaneously, and are unlimited in number;

an outermost telescopic element 15 which carries pulleys 16, can be pegged in the extended position and receives a jack 17 which is intended to control pivoting of the boom of the crane in the vertical plane and which is placed in a mortise in the element 15; and a boom consisting of:

a pivoting element 18;

an outer section 19 and, by way of example, one or more inner sections 20 (only one is shown) which can slide inside the section 19; section;

a head section 21 carrying pulleys; and a mast 22 and ties 23.

Figure 3:
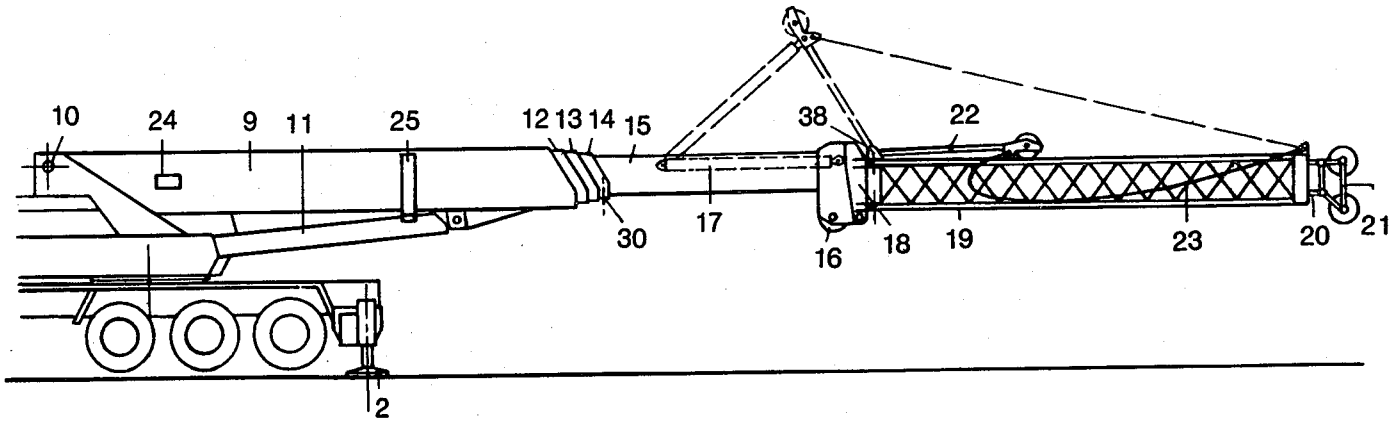
FIG. 3 shows, in side elevation, the boom open and the last section of the shaft extended, both ready for use.

The erection process, which will be understood by referring to FIGS. 3 to 6, is as follows:

Starting with the crane in the folded condition but on its steadying feet 2 and the boom 19, 20 attached at 24 along the base element 9 of the shaft 8:

the boom is freed from its attachment 24 and then, by means of a slight pivoting movement about vertical articulation 25, the axes A and A' (FIG. 2) are caused to coincide, the axles 26 are positioned, the boom is caused to rotate through 180°, so as to align it with a line projection of the shaft 8, and then the axles 27 are placed between the pivoting element 18 and the outer section 19 (FIG. 5), flexible hydraulic tubes 28, (FIG. 2) which are stored on a hydraulic winding-drum 29, are connected to the couplings arranged at the head of the shaft and intended for feeding the jack 17, and then, as represented schematically in FIG. 3, the end element 15 of the shaft is telescoped and immobilized by means of a locking system 30, the rod of the jack 17 is extended until its end coincides with the upper end of the mast 22, and axle 31 (FIG. 5) is placed so as to couple the said ends, a cable 36 of the boom which is passed over the pulleys on the mast 22 and on the boom head section 21 (see FIGS. 4 and 6), the rod of the jack 17 is retracted, which has the effect (FIG. 3) of erecting the mast 22 by rotation about articulation 38 and of automatically placing the ties 23 under tension, axles 32, joining the shaft head to the pivoting element 18 (see FIG. 5), are removed. In cases where the boom must have the maximum length, as shown in FIG. 4, it will suffice to extend the telescopic elements 13 and 14 partially, remove the axles 33 (FIG. 6), place the end of the head section 21 on the ground and retract the telescopic elements to the point where the inner section 20 is sufficiently extended from the outer section 19, and then, finally, to replace the axles 33, and a boom hook 34 is rigged with pulley-blocks and the equipment is then erected (FIG. 4).

FIG. 7 shows the boom in operation. It is seen that, by acting on the jack 17 causing pivoting about the articulation 37 (FIG. 5), the boom can move between a position I which corresponds to a zero angle relative to the shaft, the jack 17 being entirely retracted, and an extreme position II which is indicated by dotted lines and corresponds to the maximum possible angle of inclination relative to the shaft, the jack 17 being totally extended. It is seen that in the above described crane it is possible to assure, with absolute safety, the extreme working angles of the boom, which is not the case with known systems in which the angular variation of the boom is carried out by means of a winch or by partial telescoping of the shaft.

FIG. 8 schematically represents the hydraulic feed of the jack 17. This feed, which is completely conventional, comprises a fluid reservoir 41, a pump 40 and also a distributer 39, which are located at the height of the superstructure 6, and a regulating non-return valve 35 which is located on the jack 17. When it is desired to extend the rod of the jack 17, the distributer 39 is actuated so as to send the pressurized oil into the lower part and open the valve 35, which makes it possible to discharge the liquid located in the upper part of the jack towards the reservoir 41. By releasing the handle on the distributer 39, it is possible to block the jack 17, and therefore the boom, in any intermediate position of its stroke. Conversely, in order to retract the rod of the jack, it suffices to actuate the distribiter 39, so as to send the pressurized oil towards the upper chamber, and connect the lower chamber to the reservoir 41.

The invention is particularly but not exclusively intended for mobile cranes which can be positioned rapidly on site.

There is thus provided a telescopic crane which has a boom of variable length and can be erected extremely rapidly, of which crane the elements of the main shaft can be telescoped to different heights without difficulty, and on which the boom can only vary its inclination between two well-defined limits.

What is claimed is:

1. A telescopic crane comprising:

(a) a telescopic shaft comprising a plurality of telescopic elements;

(b) a boom of variable length comprising an outer section and at least one slidable inner section;

(c) means connecting said boom to said shaft for rotation of said boom relative to said shaft;

(d) means for varying the length of said boom and comprising a double-acting jack;

(e) a mast;

(f) means connecting one end of said mast to said boom for rotation of said mast relative to said boom;

(g) means connecting the body of said jack to one of said telescopic elements of said shaft for rotation of said jack relative to said one telescopic element;

(h) the outermost of said telescopic elements of said shaft comprising a mortise into which said jack fits in retracted position;

(i) means connecting the rod of said jack to the other end of said mast for rotation of said jack relative to said mast; and (j) tie means connecting said other end of said mast to a point on said boom located outwardly of said means connecting said boom to said mast.

2. The telescopic crane according to claim 1, wherein the point at which said tie means is connected to said boom is located at the distal end of said outer section of said boom.

3. The telescopic crane according to claim 1, wherein said jack, in retracted position, is detached from said mast and said tie means.

* * * * *